United States Patent [19]

Olson

[11] 4,275,839

[45] Jun. 30, 1981

[54] COMBINATION STABILIZER AND SPRINKLER SUPPORT FOR SURFACE HOSE

[76] Inventor: Donald O. Olson, 8765-I Olive La., Santee, Calif. 92071

[21] Appl. No.: 80,288

[22] Filed: Oct. 1, 1979

[51] Int. Cl.[3] ..... A62C 31/22

[52] U.S. Cl. ..... 239/272; 239/276; 239/280

[58] Field of Search ..... 239/271, 272, 273, 276, 239/280, 283

[56] References Cited

U.S. PATENT DOCUMENTS

| | | | |
|---|---|---|---|
| 717,042 | 12/1902 | Smith | 239/280 |
| 1,910,765 | 5/1933 | Hanlan | 239/280 X |
| 3,588,012 | 6/1971 | Schaefer | 239/276 X |
| 3,843,059 | 10/1974 | Seger | 239/273 |
| 3,856,208 | 12/1974 | Naftaly | 239/272 |

*Primary Examiner*—Richard A. Schacher

*Attorney, Agent, or Firm*—Owen, Wickersham & Erickson

[57] ABSTRACT

A two-piece stabilizer for holding a surface hose or fluid conduit in place on the ground to prevent twisting or turning normally caused by residual stresses is disclosed. A lower base member has a central saddle portion with outwardly extending arms. A clamp member connectable with the base member by irreversible integral pins secures the base in place and prevents it from turning. Modified forms of the clamp member include a spigot portion on its bottom side for penetrating the hose to form a fluid connection and a retaining sleeve portion on its upper side to hold a riser or sprinkler device.

8 Claims, 8 Drawing Figures

COMBINATION STABILIZER AND SPRINKLER SUPPORT FOR SURFACE HOSE

BACKGROUND OF THE INVENTION

This invention relates to surface irrigation or watering systems and more particularly, to a device for stabilizing a hose or plastic conduit on the ground, especially at sprinkler outlets.

Surface irrigation systems, for a multiplicity of plants or trees, commonly use relatively thin-walled plastic pipe to which are attached sprinkler or emitter devices for watering large numbers of spaced apart plants from the central water source. Heretofore, a serious problem with such plastic pipe was that, after installation, it tended to twist longitudinally with changes in environmental temperature and due to residual stresses developed during manufacturing and storage. As a result of such twisting, risers or sprinklers attached to the plastic conduits would also twist and turn after installation and consequently, the spray pattern would move off target and fail to cover the desired area. This often caused a loss of water and/or loss of plants in some instances which could only be remedied by considerable labor in checking and resetting the many outlets of such a system. The present invention provides a solution to this problem.

A further problem with surface type irrigation systems was in providing efficient but inexpensive sprinkler or emitter devices that could be held in place on, yet easily attached and secured to, a plastic hose conduit. The present invention also solves this problem while also stabilizing the conduit.

BRIEF SUMMARY OF THE INVENTION

In accordance with the principles of the invention, a hose or plastic conduit stabilizer is provided which grips the hose while also contacting the ground in such a way so as to prevent the conduit from turning. The stabilizer, preferably made of plastic, has two parts; namely, a lower base member and an upper clamping member. The base member has a length which is several times the diameter of the conduit being stabilized and is terminated at its opposite ends by enlarged footlike portions. A central saddle portion of the stabilizer provides a notch-like cradle for the hose and a stabilizer clamp fits over the cradle and is retained by the base member as it presses firmly against the hose. The clamp, in some instances, is configured to serve as holder for a sprinkler device that contacts and penetrates the hose just below the clamp. Thus, the clamp may perform a dual purpose in many installations. All of the components of my hose stabilizer, according to the invention, may be made of relatively inexpensive plastic materials, in large quantities, using conventional molding and manufacturing techniques and procedures. Therefore, the stabilizer is particularly well adapted for ease and economy of manufacture.

Other objects, advantages and features of the present invention will become apparent from the following detailed description presented in conjunction with the accompanying drawing.

DETAILED DESCRIPTION OF EMBODIMENTS

Figure 1:
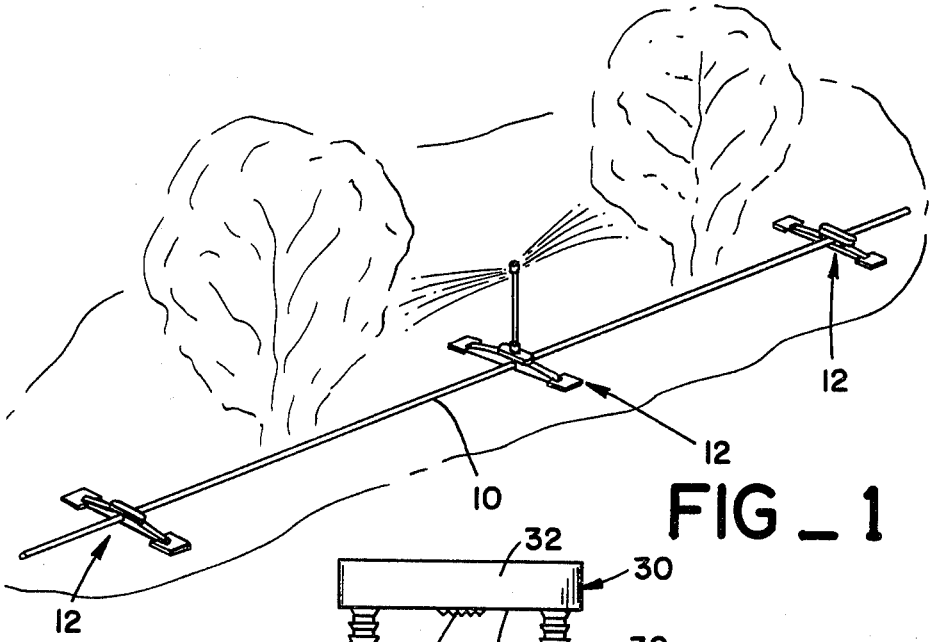
FIG. 1, is a view in perspective, showing a typical surface water conduit being held in place by stabilizers according to the present invention.
Figure 2:
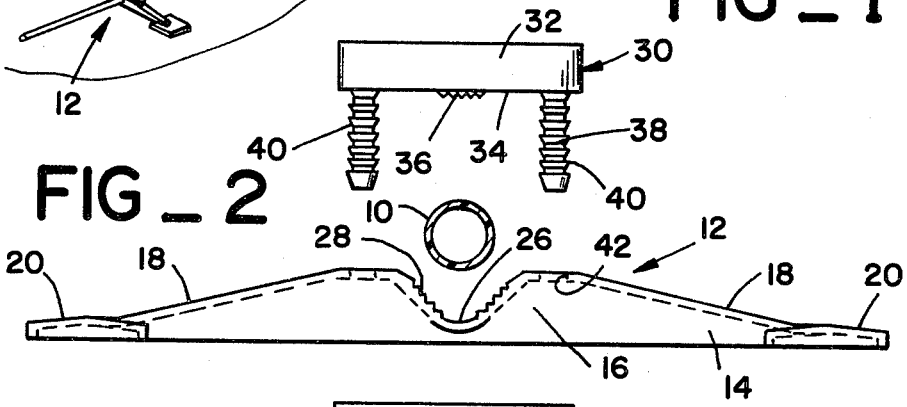
FIG. 2, is an exploded view in elevation, showing a hose stabilizer according to the invention.
Figure 3:
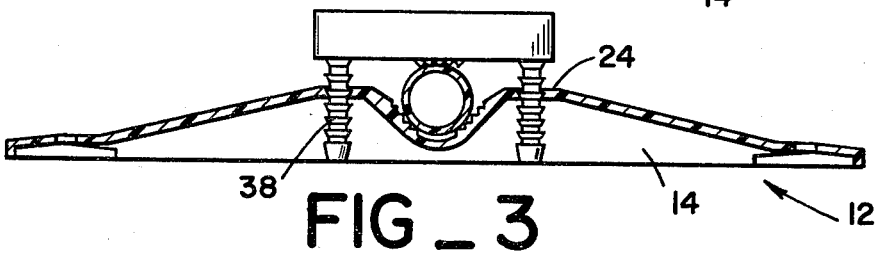
FIG. 3, is a view of the hose stabilizer of FIG. 2 as it appears when assembled, with the base member shown in section.
Figure 4:
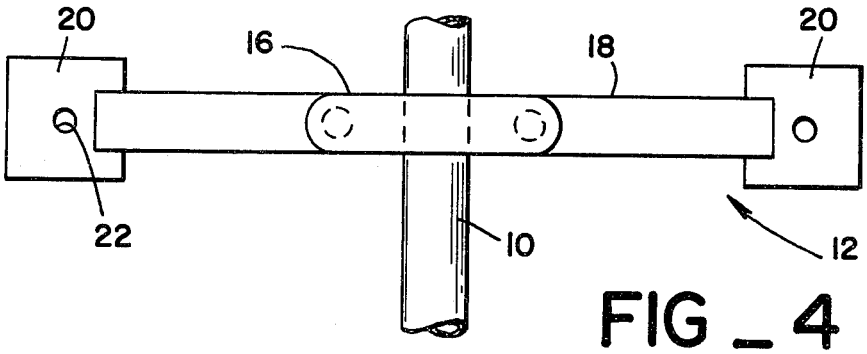
FIG. 4, is a plan view of the hose stabilizer of FIG. 3.

Referring to the drawing, FIG. 1 shows a portion of a typical surface type irrigation or sprinkler system wherein a conduit or hose 10 on the ground extends between a plurality of plants or trees. Such hose, usually made of a plastic material such as polyvinylchloride (PVC), tends to twist on the ground due to residual stresses created by manufacturing or storage. However, in accordance with the invention, stabilizer devices 12 are fixed to the hose at intervals to prevent such twisting.

As shown in FIG. 1, the stabilizer 12 comprises an elongated base member 14 adapted to be positioned transversely under the base which it is supporting. This base member is preferably molded from a rigid molded plastic material (e.g., PVC) and has generally the shape of an isosceles triangle with a somewhat higher center portion 16 that slopes downward and outwardly along the top surfaces of opposite extending arms 18. These arms may extend for four to five inches from the center of the base member and each terminates at an integral and somewhat wider foot portion 20 at its outer end. The bottom edges of the base member from one foot portion to the other are all in the same plane so that it will lie flat against the ground surface. Each foot portion has a centrally located hole 22 to facilitate the use of a peg or pin to secure the stabilizer to the ground if necessary. To conserve material, while maintaining adequate strength, the base member, including the arms and their foot portions, is preferably essentially hollow, its triangular shape being maintained by material having a thickness of approximately 0.10 inches.

At the center portion of the base member, the top surface has two short, flat surface areas 24 located on opposite sides of a central notch or recess 26 to provide a holding saddle for the base to be supported. The surface within this notch, particularly along its sloping sides and its bottom portion, is provided with a series of relatively sharp molded serrations 28 that extend parallel to the direction of the hose being supported and tend to keep it from rotating.

Now, in combination with the base member, is an upper clamp member 30 which is also preferably molded from rigid plastic material. This clamp member comprises a relatively short and generally rectangular shaped body 32 that extends between the two flat surfaces on the top of the base member. At the center of an otherwise smooth bottom surface 34 is a series of integral serrations 36 similar to those in the saddle of the base member. Integral with the body 32 and extending vertically downward from its bottom surface 34 at its opposite ends, is a pair of integral pin-like portions 38. Each of these pin-like portions are molded with a series of serrations or tapered rings 40 which form barbs that provide a means for locking the clamp member 30 to the base member 14. A hole 42 is provided at the center of and extends completely through the material of each flat surface on opposite sides of the saddle portion of the base member.

Thus, in using a stabilizer 12, the base member 12 may be placed on the ground and secured (if necessary) by pins (not shown) through the holes 22 in the foot members 20. The plastic hose 10 can then be placed transversely in the saddle portion 26 of the base member. With one downward stroke, the clamp member 30 may be connected permanently to the base member by forcing its pin-like portions 38 through the foot member holes 42. Once in place, the tapered rings, acting like barbs, prevent any reverse movement by the pin-like portions 38. Thus, the hose is held firmly in place and cannot slip or turn because of the saddle serrations 28 and the similar clamp serrations 36. The stabilizer 12 itself cannot turn because of its ground engaging arms 18 and integral outer foot members 20.

Figure 5:
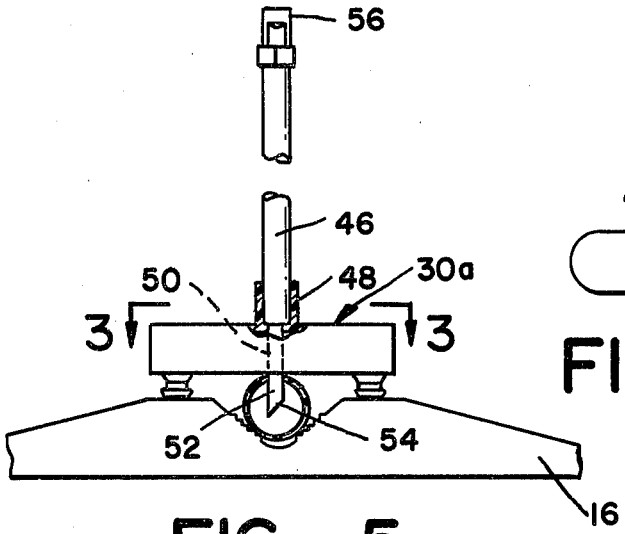
FIG. 5, is a fragmentary view in elevation of a modified form of hose stabilizer which also serves as a riser support.
Figure 6:
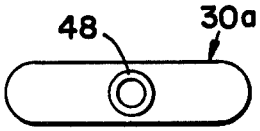
FIG. 6, is a fragmentary plan view of the stabilizer/-riser of FIG. 5.

In another embodiment of the invention, shown in FIGS. 5 and 6, a modified clamp member 30a may be used with the same base member 12, not only to hold the hose in place but also to provide a means for connecting it with and supporting a small riser 46. Here, the clamp body has a centrally located circular sleeve portion 48 that projects upwardly from its upper surface. Aligned with the axis of this sleeve portion is a vertical passage 50 that extends downward through the clamp body and through an integral spigot portion 52 that extends downwardly from the bottom surface of the clamp body. The bottom end of the spigot portion preferably has a beveled surface 54 which forms a sharp point enabling it to readily penetrate into the plastic hose 10 when the clamp member 30a is forced downwardly into the base member 16, as previously described.

Now, to form the riser 46, using the clamp member 30a, a preselected length of plastic tubing having the same outside diameter as the inside diameter of the clamp sleeve portion 48, is inserted therein so that it remains upright. Fixed in the end of the rise tube is a small plastic spray device 56 of the type such as shown in my co-pending U.S. patent application Ser. No. 924,289.

Figure 7:
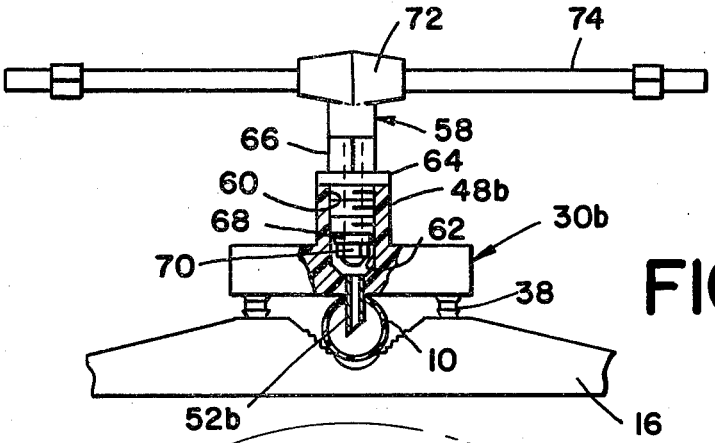
FIG. 7, is a fragmentary view in elevation of another modified form of the invention, showing a hose stabilizer which also serves as a support for a sprinkler.
Figure 8:
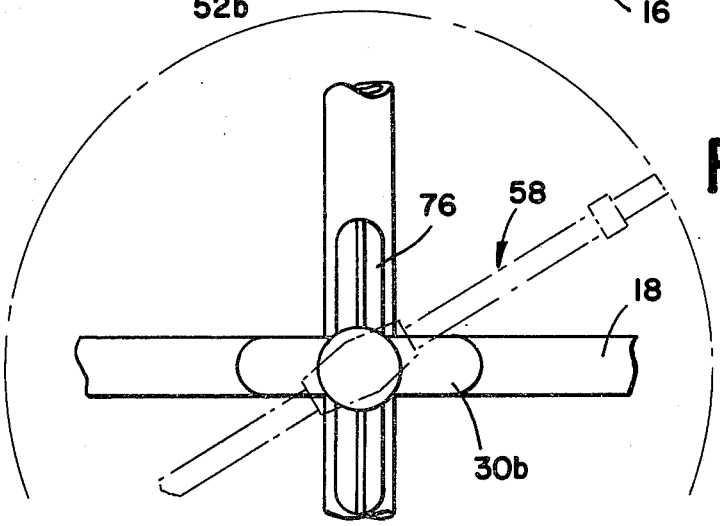
FIG. 8, is a fragmentary view of the stabilizer/sprinkler of FIG. 7.

In yet another modified form of my invention, as shown in FIGS. 7 and 8, a clamp member 30b may be provided for supporting a small rotary sprinkler 58 of the conventional type. Here, a similar beveled spigot 52b is provided that extends from the bottom surface of the clamp body. On the upper surface, a somewhat larger integral sleeve portion 48b is provided which has a series of internal threads 60. Below these threads is a recess 62 within the clamp body adapted to accommodate the lower end of the sprinkler assembly. The latter comprises a plastic bushing member 64 with external threads 64 to enable it to be threadedly secured within the sleeve portion 48b of the clamp body. The bushing member has an upper hex shaped head 66 to facilitate its installation. Extending axially through the bushing member 62 to the lower end of which is threaded a lock nut 70. The upper end of the hollow shaft is fixed to a hollow plastic connector 72 from opposite sides of which extend a pair of sprinkler arms 74. Thus, a water forced through the spigot portion 52b of the clamp is fed into the aligned hollow shaft 68 of the sprinkler and flows out through the sprinkler arms 74 which are bent slightly to cause them and the shaft 68 to rotate within the bushing member.

To provide additional support for the sprinkler assembly during its operation, the clamp member 30b may be provided with additional short stabilizing arms 76 which extend from opposite sides of its clamp body and over the hose 10, as shown in FIG. 8.

From the foregoing, it should be apparent that the present invention provides a simple but highly versatile hose stabilizer that can provide several functions in forming an efficient surface watering system. The relative simplicity of construction which enables quick and efficient assembly of the various components enables large numbers of stabilizers to be used at relatively low cost.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A stabilizing device for holding a hose in a preselected position on the ground and preventing it from twisting or turning due to residual stresses, comprising:

a base member adapted to extend transversely to the hose being stabilized, having a central portion provided with a recess for receiving the hose and integral arms extending from opposite sides thereof; and clamp means extending across said recess connectable with said central portion of said base member and adapted to bear against, and hold firmly, a hose extending through said recess so as to prevent the hose from twisting, wherein said central portion includes a pair of top surfaces on said central portion on opposite sides of said recess and having respective smoothwalled openings; said clamp means including an elongated body portion parallel with said base member and provided adjacent its ends with integral, downwardly projecting pin portions having barbs, adapted to interlock with the walls of the openings upon direct axial force on said pin portions.

2. The stabilizing device, as described in claim 1, including enlarged foot members at the outer ends of said arms and means for securing them to the ground.

3. The stabilizing device, as described in claim 1, wherein said central portion includes a saddle-like recess with sloping sides and serrations on said sides for gripping the hose surface.

4. The stabilizing device, as described in claim 1, wherein both said base member and said clamp means are molded separately from plastic material.

5. The stabilizing device, as described in claim 1, wherein said clamp means includes a cylindrical sleeve portion on its upper side for supporting fluid outlet means and a spigot means on its lower side for penetrating a hose in said base member when attached thereto.

6. The stabilizing device, as described in claim 5, wherein said sleeve portion is relatively small in diameter; a short piece of tubing mounted within, and extending upwardly from said tubing; and a spray device in the upper end of said tubing.

7. The stabilizing device, as described in claim 5, wherein said sleeve portion is relatively large and has internal threads for retaining a bushing member; a rotatable, hollow shaft supported within and extending above said bushing member; and rotatable sprinkler means with radially extending arms fixed to the upper end of said hollow shaft.

8. The stabilizing device, as described in claim 7, including a pair of short stabilizing arms extending perpendicular to the clamp member and adapted to extend over and parallel to a hose retained in said base member.

* * * * *